United States Patent [19]

Christensen et al.

[11] 4,122,006

[45] Oct. 24, 1978

[54] SCREENING APPARATUS

[75] Inventors: Elmer Christensen, Kirkland; Kenneth M. Cage, Marysville, both of Wash.

[73] Assignee: Black Clawson, Inc., Everett, Wash.

[21] Appl. No.: 837,376

[22] Filed: Sep. 28, 1977

[51] Int. Cl.[2] ..... B07B 1/54

[52] U.S. Cl. ..... 209/382; 209/322; 209/332

[58] Field of Search ..... 209/381–383, 209/277, 340, 336, 332, 282, 322, 320, 379, 351, 331; 210/413

[56] References Cited

U.S. PATENT DOCUMENTS

| | | | |
|---|---|---|---|
| 266,177 | 10/1882 | McKeen | 209/382 |
| 3,070,230 | 12/1962 | Peterson | 209/382 |
| 3,087,617 | 4/1963 | Forsberg | 209/382 |

*Primary Examiner*—Robert Halper
*Assistant Examiner*—Jon E. Hokanson
*Attorney, Agent, or Firm*—Biebel, French & Nauman

[57] ABSTRACT

In a rotary screen for sorting wood or other particles of a desired size from other particles such as fine, moist, sticky sawdust particles, a plurality of balls are suspended beneath the screening surfaces in a manner such that the gyratory motion of the rotary screen imparts a resonant, pendulum-type motion to the balls, causing them to strike the bottom of the screening surfaces and loosen particles from the screen which would tend to clog the openings therein. The rotary screen includes a collection tray or "dust pan" to catch undersize particles, and a plurality of balls are also suspended beneath the bottom surface of the dust pan to strike it and prevent material build up in the dust pan.

12 Claims, 11 Drawing Figures

SCREENING APPARATUS

BACKGROUND OF THE INVENTION

1. Field of the Invention

The present invention relates to particle screens, and more particularly, to rotary screens of the type which includes inclined screen plates and a dust pan which are driven as a unit in a gyratory path by means of an eccentric drive.

2. Prior Art

A variety of screening devices are presently available for sorting different particles into various size ranges for subsequent use, such as in the making of paper, the manufacture of particle board in the food industry for screening rice and in the rock industry for screening asbestos and asbestos fibers. These screening devices generally consist of screening surfaces which are inclined in one plane and agitated by a proper mechanical motion. The characteristics of the screen motion are selected for the best combination of material conveying abilities and particle size separation efficiencies.

However, such screens often become clogged. For example, in screening wood particles, wet, sticky sawdust particles may clog the screen, and particularly in cold weather when these particles tend to freeze to the surface of the screen, clogging of the screen results with reduced screening efficiency. Often the result is that the screens must be temporarily shut down and cleaned by hand at frequent intervals.

One approach to this problem has been to support trays of balls in the screen assembly which randomly impact the bottom of the screening surfaces during movement thereof. Screen assemblies of this type are generally composed of a rectangular frame structure with a plurality of cross braces extending through the open central region of the frame structure, with a screen of the desired mesh attached to the top of the frame structure, supported by the cross braces.

The balls are then placed within the rectangular openings formed by the cross braces and the outside frame structure and a latticework having sufficiently small openings tp prevent the balls from passing through it is secured to the bottom of the frame. The balls are thus contained in the compartments formed by the rectangular openings, screen and latticework and, theoretically, engage the bottom surface of the screen when they bounce due to the motion of the screen assembly. An example of a device of this type is illustrated in Simpson U.S. Pat. No. 2,114,406.

Although effective under normal operating conditions, this type of anti-clogging device is not sufficient to prevent operating problems under more severe conditions. Wet or otherwise sticky particles tend to build up inside the ball compartments, thus restricting the mobility of the balls to the point where they become ineffective. The ball compartments then quickly fill up with sticky particles and the screening apparatus ceases to function.

SUMMARY OF THE INVENTION

The present invention overcomes the above described difficulties and disdvantages associated with prior art screening apparatus by providing a rotary screen assembly in which a plurality of impacting members are suspended beneath surfaces of the screening apparatus in a manner such that they swing in resonance with the screen oscillation frequency and impact the surfaces of the screening apparatus beneath which they are suspended.

The present invention is intended particularly for use with screens which are driven such that they move in a gyratory path as opposed to screens which are simply vibrated, for example, since the motion imparted to the suspended impacting members must cause them to move in a resonant, pendulum-like motion to impact the screening apparatus surfaces with sufficient momentum.

The impacting members may be suspended beneath any surface of the screening apparatus where the collection or adherence of particles in any quantity would be likely to interfere with operation of the screening apparatus. However, the primary areas of concern are the screening surfaces themselves and the collection tray or "dust pan".

With regard to the dust pan a problem similar to that described above with respect to the screen surfaces occurs in that moist and sticky fine material tends to adhere to the dust pan and freeze to it in colder weather so that the fine material will not flow along the pan in the manner intended. Gradually the sticky material fills up the dust pan to an extent which necessitates machine shut down for time consuming, manual cleaning.

Generally, the screening apparatus in which the present invention is intended to be utilized is in the form of a plurality of screening assemblies wherein the screens are of increasingly finer mesh going from the top to the bottom of the apparatus with a dust pan beneath the last screen for collecting the finest particles of material. Taking wood particle screening as an example, the particles are usually sorted into at least three catagories, viz., "overs" which are too large for the intended subsequent processing, "accepts" which are of accceptable size and "fines" which are too small for use in subsequent processing.

The screens and the dust pan are disposed generally parallel to each other, but slightly inclined with respect to the horizontal so as to cause migration of the particles being sorted from one end of the screen to the other as a result of the screen motion. Also, each of the surfaces of the individual screens may be associated with a discharge spout at the output end of the device, for discharging particles of each size which have been restrained from passing through a particular screen. A discharge spout is also provided for the dust pan.

The weight of the impacting members, which can conveniently be in the shape of balls although obviously a variety of other shapes may be used, and the length of the strands which support the impacting members or balls beneath the surfaces of the screens are critical in that in order to produce proper functioning of the apparatus, it is necessary to have the proper weight of ball and length of strand such that a resonant, pendulum-like movement of the impacting member will be induced when the screening assembly is driven in a gyratory path.

In addition to the use of a single impacting member suspended by a single strand it is contemplated that a plurality of impacting members may be suspended in spaced relation along a single strand of flexible material with both ends of the strand being fixed beneath the screen so that a swinging, resonant, pendulum-like motion of the impacting members is induced by the motion of the screen.

The ends of the strands holding the impacting members would have to be located in a plane generally perpendicular to the direction of reciprocating motion of the screen assembly in those cases where a longitudinal or transverse reciprocating movement was utilized. However, in the case of a gyratory reciprocating screen assembly, the location of the ends of the supporting strand is not as critical, since some component of force will act on the strands regardless of their position, due to the circular motion of the screen assembly.

The manner in which the impacting members are suspended beneath the screen or dust pan is also important. The screen assembly may be driven at a frequency of, for example, approximately 180 cycles per minute. This results in substantial flexural stress on the suspending strands at their points of attachment to the screen assembly, and precautions should be taken to reduce these stresses to reduce frequency of failure of the supporting strands.

Therefore, several alternative means have been devised for securing the strands to the screening assembly so as to substantially enhance their useful service life. A first means comprises the use of a conically shaped elastic plug of rubber or the like secured to the end of the supporting strand opposite the end attached to the impacting member. The plug is forced into a smaller but correspondingly shaped opening in a suspension bar positioned beneath the screen surface with the conical shape converging downwardly. The lower end of the plug is forced through the opening so that it protrudes below the suspension bar to act as a soft bumper or guide for the suspension strand during swinging movement thereof.

An alternative means for securing the supporting strands to the screen assembly includes the use of a ball-shaped member secured to the upper end of the strand. The ball-shaped member is preferably made of nylon or similar material although harder materials may be utilized. It is inserted in a corresponding cavity formed in the suspending bar, which cavity can be formed, for example, by using two mating sheet metal plates having opposed, cavity-forming indentations with a flanged hole through the lower plate.

The plates are then secured together with the strand extending through the hole in the lower plate and the ball-shaped member supported in the cavity. The ball-shaped member is loosely fitted in the cavity so that it can rotate when the impacting member suspended from the other end of the strand swings to impact the screen.

A further method of suspension for the supporting strands includes providing the upper ends of the strands with crimped on fittings received in cavities formed in the suspension bars running beneath the screen surfaces. A plate is then attached to the bar at each point of suspension with the plates having openings formed therethrough communicating with the cavities formed in the suspension bars. The crimped on fittings on the upper ends of the suspension strands are received in the cavities formed in the bars and held in place by the plates affixed to the bars with the strands extending through the openings in the plates. The plate openings are contoured such that they are provided with a gradually increasing radius of curvature to reduce stress concentrations at the point of bending adjacent the upper end of the suspension strands.

While the description above deals with attaching the supporting strands such that the balls move with a pendulum-like motion, it should be noted that the term pendulum-like motion is intended to encompass suspensions wherein the suspension strand is something other than completely flexible. That is, although in the ideal, theoretical case a characteristic of pendulum-type motion is that it is independent of the bending stiffness of the supporting strand, it is within the scope of the present invention to use, instead of a completely flexible suspension strand, a suspension strand having some degree of stiffness such that it acts in the manner of a spring support.

It is also within the scope of the present invention to utilize a substantially rigid strand, such as a steel shaft, which is pivotally mounted at its upper end to a mounting bar and carries a ball or other impacting member at its lower end.

The above examples are merely illustrative of suspension methods for the impacting members, and it will be apparent that the present invention is not limited to any particular type of suspension and various types of suspensions can be utilized within the scope of the present invention.

DESCRIPTION OF THE PREFERRED EMBODIMENTS

For purposes of illustration, the following description will be in the context of screening wood particles, such as wood chips, although it will be apparent that the present invention is susceptible of use with a variety of materials.

Figure 1:
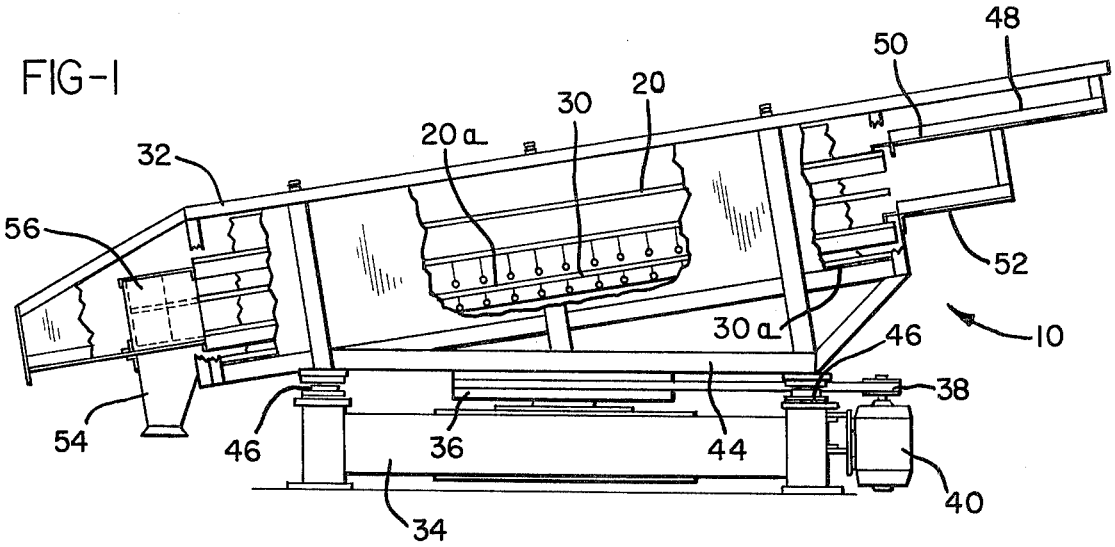
FIG. 1 is a side elevational view with portions removed of screening apparatus in accordance with the present invention.

Screening apparatus 10 as illustrated in FIG. 1 incorporates a preferred embodiment of a screening assembly 20 and a dust pan or collecting tray 30, both constructed in accordance with the present invention. The remainder of the screening apparatus 10 is considered to be of conventional construction, but will be described generally by way of background for utilization of the preferred embodiments of the present invention.

The screening apparatus 10 includes a screening "box" 32 which contains the screening assembly 20 and dust pan 30, all of which are somewhat inclined with respect to the horizontal so that material introduced at the elevated end will migrate towards the lower end due to motion induced in the assembly. The box 32 is basically a frame construction for containing the screening assembly 20 and dust pan 30, and is supported for movement above the stationary base 34.

Figure 2:
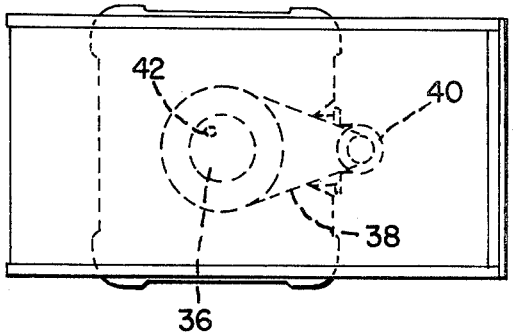
FIG. 2 is a diagrammatic top plan view of the drive mechanism incorporated in the embodiment illustrated in FIG. 1.

In the preferred embodiment illustrated, the movement of the unit is gyratory and is induced by an eccentric rotating cam member 36, as schematically illustrated in FIG. 2, driven by a belt 38 which in turn is driven by a motor 40. An eccentric post 42 fitted on the top of the rotating member 36 mates with a hole in frame 44 which in turn is secured to the box 32 and mounted for movement therewith. Bottom frame 44 is rectangular and is supported at each corner above the stationary base 34 by rolling ball mechanisms 46, designed to follow the movement imposed by rotation of the rotating member 36 so as to cause the box 32 to follow the gyratory motion imposed by the movement of eccentric post 42.

Other forms of reciprocating mechanisms may be utilized which will cause the box 32 to reciprocate transversely or longitudinally thereof, although the gyratory motion described above is preferred.

Screening apparatus of this type utilizes one or multiple screening surfaces depending upon the number of sorts desired. The embodiment illustrated in FIG. 1 utilizes two screening assemblies 20 and 20*a* which are essentially identical in this embodiment and provide twice the screening surface is essentially the same envelope as would otherwise conventionally be available. This particular construction of wood particle screening apparatus is more useful as an intermediate stage where the overs have already been screened out in a prior screening process and the screening apparatus 10 can then be used to sort the accepts from the fines.

Of course, it would be possible within the scope of the present invention to incorporate an "overs" screening step through the use of a relatively open mesh screening plate disposed above each of the screen assemblies 20 and 20*a* or in place of the upper screen 20, whereby the material to be sorted would first pass over the relatively open mesh screen, with both the accepts and the fines passing through this screen and overs being collected on the screen and disposed of accordingly. The particular construction of the overall screening apparatus 10 is not particularly important since the present invention is compatible with many designs, the present one merely being by way of example to show the preferred embodiment of the present invention being utilized in a screening apparatus.

In the preferred embodiment of the screen 10 illustrated in FIG. 1, the wood particles comprising accepts and fines are introduced onto a landing area 48 which is a sheet metal plate. Due to the motion of the box 32 as described above, the material migrates down the inclined landing area into the flow separation area 50 in which the plate is provided with a plurality of openings through which approximately 50% of the material to be sorted is permitted to fall onto the second landing area 52 while the remainder of the material passes onto the upper surface of the screening assembly 20.

The material which has passed to the second landing area 52 likewise passes to the screen assembly 20*a*, and the accepts are separated from the fines by the screen assemblies 20 and 20*a*. The fines are permitted to pass through the screens and land on dust pans 30 and 30*a* which are respectively associated with the screen assemblies 20 and 20*a*. The accepts and fines are carried to the lower end of the box 32 and are collected in different collection systems with the fines passing out through the outlet collector 54 while the accepts are collected in the accepts outlet collector 56 and removed from the screening apparatus 10 for subsequent use.

Figure 3:
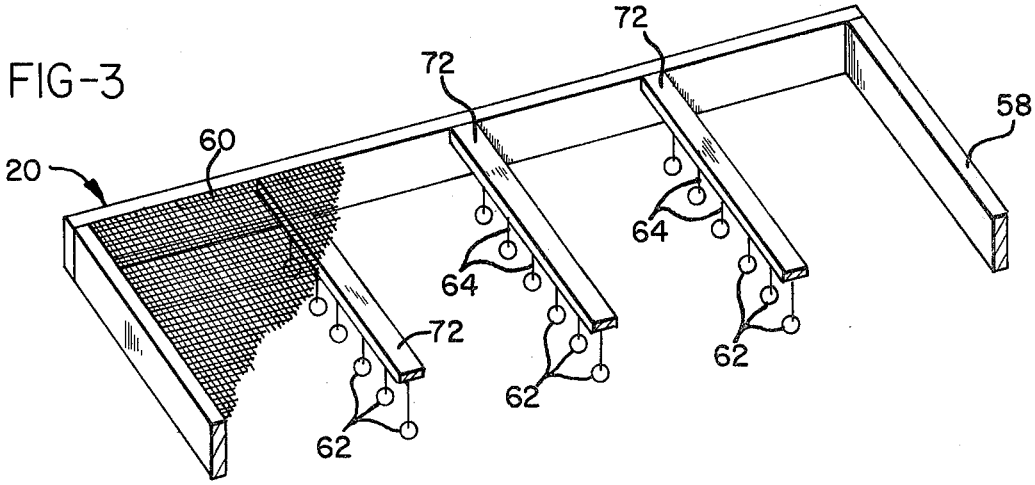
FIG. 3 is a perspective view of a portion of one of the screen assemblies utilized in the embodiment illustrated in FIG. 1.

The construction of the screening assembly 20 is illustrated in FIG. 3 and basically comprises a frame structure 58 and a screening member 60 generally composed of a wire mesh screen having the proper mesh to restrain the passage of acceptable sized wood particles while permitting fines to pass therethrough.

Supported beneath screening member 60 are a plurality of impacting members 62 each of which is suspended by means of a strand 64 from a bar 72 extending across and supported by the frame structure 58. While impacting members 62 are shown as balls, it will be apparent that other shapes may also be used. Actual spacing of the members 62 from one another and the spacing between bars 72 will depend upon several factors including moisture content of material and fineness of material. This is so because the impact of the balls 62 on the underside of the screening surface 60 will have an area of effectiveness in loosening material stuck in the mesh of the screen member 60, and it will be necessary to make these areas overlap sufficiently to cover substantially the entire working area of the screen member 60.

Figure 5:
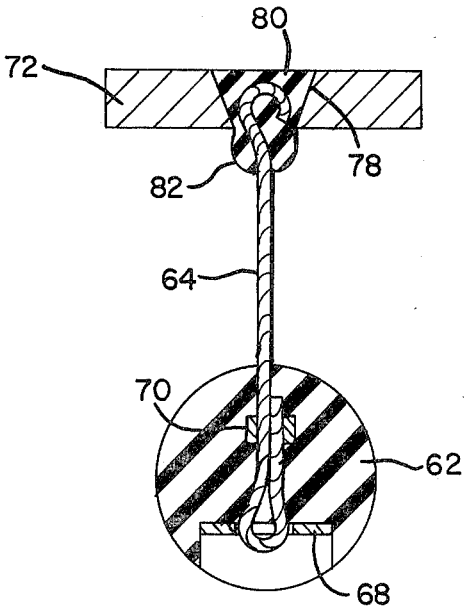
FIG. 5 is a enlarged view of a ball suspended by a supporting strand from a support bar in accordance with the present invention.

Alternative methods of suspending the balls 62 are illustrated in FIGS. 5 through 9. In FIG. 5 a ball 62 is shown supported by a flexible strand 64 secured at its upper end to bar 72. Members 62 can be made of any material, although resilient materials such as natural or synthetic rubber have proven particularly suitable. The density of the members 62 is a substantial factor in the effectiveness of cleaning the screen member 60 in that higher density or heavier impacting members have a greater impact force and thus are more effective in dislodging materials stuck to the screen member 60. Although resilient members 62 are preferred, the use of heavier, rigid members, made for example of stainless steel, or lighter members, is not to be ruled out.

Flexible strand 64 is preferably made of steel cable or other relatively durable flexible material, although any flexible material which will have a reasonable life under the flexural conditions existing in the present invention is acceptable. As shown in FIG. 5, one method of securing flexible strand 64 to ball 62 is by inserting strand 64 through a corresponding diameter hole in the ball, looping it through two holes in a circular washer 68 and then securing it to itself with crimp ring 70. This can be accomplished by cutting appropriate openings in a solid ball or by forming the ball about the strand 64, washer 68 and crimp ring 70.

The manner in which flexible strand 64 is secured to bar 72 is important in that there is a high flexural stress area at the juncture of the strand 64 with the bar 72 which will cause substantial wear on the strand 64 over extended periods of use. One way of overcoming this difficulty is to use a tapered hole 78 formed in the bar 72 which narrows toward the bottom of the hole where the flexible strand 64 extends toward the ball 62, as illustrated in FIG. 5. A resilient tapered plug 80 is secured to the upper end of the strand 64 either by preforming it about strand 64 or providing a connecting means similar to that used for ball 62. Plug 80 has a taper approximating that of opening 78.

In assembly, strand 64 is inserted in the opening 78, and the ball 62 and plug 80 are attached in the desired manner. Plug 80 is then compressively forced into opening 78 so that it is compressed to constrain the movement of strand 64. It is also preferable that a small end portion 82 of plug 80 be forced out of the bottom of opening 78 so that strand 64 will not be in contact with bar 72 when ball 62 swings to make contact with the screen member 60.

Figure 6:
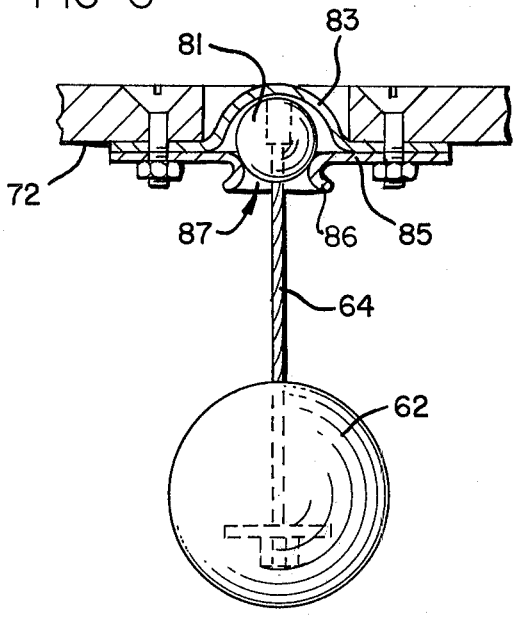
FIG. 6 is an enlarged view of an alternative means of connection between a supporting strand and a support bar.
Figure 8:
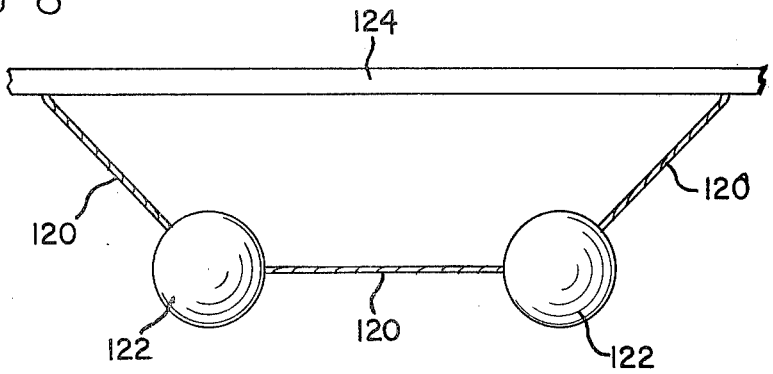
FIG. 8 is a schematic view of means for suspending a plurality of balls with a single supporting strand.

A second alternative means of securing the flexible strand 64 to the suspension bar 72 is illustrated in FIG. 6. In this embodiment the ball 62 is secured to flexible strand 64 in the same manner as before, but instead of a plug 80 a ball-shaped member 81 is secured to the upper end of flexible strand 64. Member 81 is preferably made of nylon or similar material although alternative materials, such as steel, can be utilized.

A pair of steel plates 83 and 85 are secured to bar 72 and are formed with a cavity for receiving member 81 so that it fits loosely enough therein to freely rotate when ball 62 swings. Strand 64 extends down through opening 87 in plate 85 which has a curved flange portion 86 against which the strand 64 rests when ball 62 impacts the screen.

Figure 7:
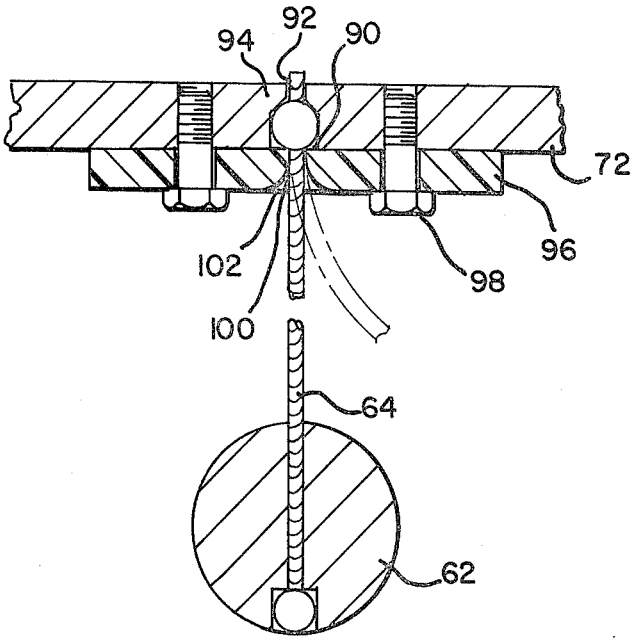
FIG. 7 shows still a further means of attaching a supporting strand to a support bar.

With reference to FIG. 7 of the drawings, still a third embodiment of suspension means will be described. Bar 72 is provided with a cavity 90 therein having a small opening 91 communicating with the upper surface of the bar. A ball 62 is attached in any convenient manner to a flexible strand 64 having a crimped on fitting 94 secured to its upper end and received in the cavity 90 with a portion of the strand projecting upwardly through the opening 92.

A plate 96 is secured to the bar 72 by means of bolts or the like 98 and the plate 96 is provided with an opening 100 having smoothly curved walls 102, the radius of curvature of which gradually increases outwardly away from the bar 72. The upper end of the strand 64 is snugly received in the opening 100 adjacent the cavity 90. This type of attachment prevents bending of the strand 64 near the crimped on fitting 94 where there is already a stress concentration and also limits the bend radius of the strand 64 in the most critical area.

While the above description deals with an almost ideal pendulum, in that the strands 64 are flexible enough that they approximate the suspension of a true pendulum, it is within the scope of the present invention to utilize a somewhat stiffer suspension means for the balls 62.

Figure 9:
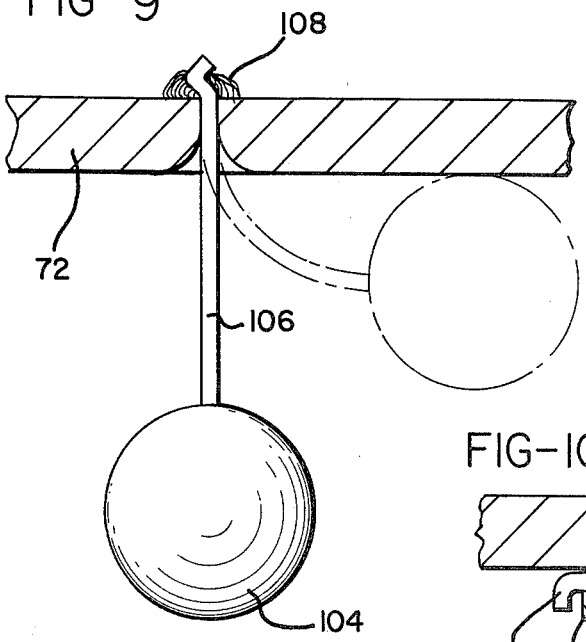
FIG. 9 illustrates a spring-type ball suspension.

Thus, as seen in FIG. 9 of the drawings, a ball 104 is attached in any suitable manner to a strand 106 which may be formed of a spring steel having a known spring constant. Strand 106 is in turn attached by means of a rigid connection 108 to a bar 72. When the natural frequency of the spring-mass system is a harmonic of the screen motion frequency, resonant motion of the balls 104 is obtained, as indicated in phantom lines in FIG. 9, causing the balls 104 to strike the under surface of the screen with which they are associated.

Figure 10:
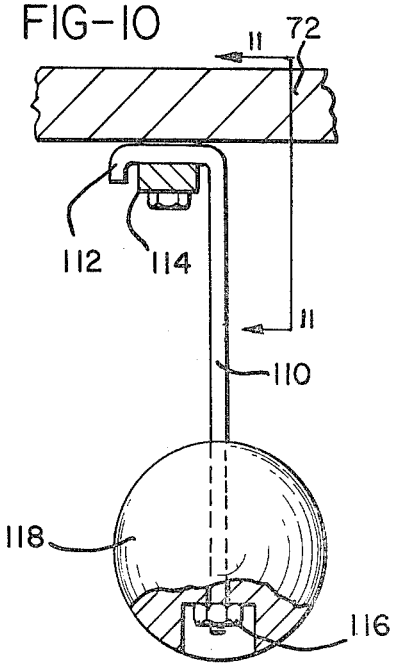
FIG. 10 is a view of a rigid shaft, pivoted type suspension.
Figure 11:
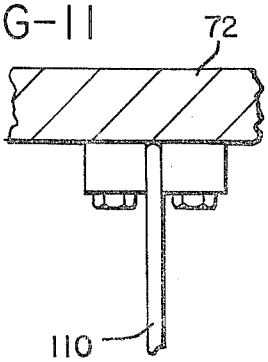
FIG. 11 is a view taken on line 11—11 of FIG. 10.

In FIGS. 10 and 11 another form of impacting member suspension is illustrated. As seen there a substantially rigid strand 110, such as a steel rod, is provided with a hook 112 at its upper end which is pivotally mounted by means of a grooved pivot block 114 of ultra high molecular weight polyethylene or other suitable material which is attached to the bar 72. The lower end of strand 110 may be threaded to receive a retaining nut 116 to secure an impacting member 118 to the strand 110. As in the previous embodiments the length of the strand and mass of the member 118 are selected such that the member 118 impacts the surface beneath which it is mounted.

Referring again to FIG. 3, a plurality of balls 62 are suspended from a plurality of the bars 72 just below the bottom surface of screen member 60. When the balls 62 begin to swing back and forth in a plane in resonance with the frequency of gyration of the screening member 60, they will strike the bottom of the screening member and dislodge frozen or sticky particles which tend to collect on the top surface of the screening member.

It has been discovered that by adjusting the mass of the balls 62 and length of flexible strands 64, an appropriate relationship can be established which causes the pendulum-like members to go into resonant vibration in a plane rather than follow the circular oscillation of the screen assembly 20. While the resonant motion of the pendulums is predictable from engineering principles, difficulties will be encountered in calculating the length of the pendulum because it depends on the combined elastic effect of the ball, the suspension means and the impacted surface. Since these elastic data would have to be determined experimentally in order to be able to calculate the length of the cable, it is simpler and more expedient to simply determine the length experimentally.

For example, in order to establish this, an arbitrary mass constituting ball 62 may be utilized, and the length of flexible strand 64 can be varied until the pendulum-like member goes into oscillation in a plane rather than following the circulatory oscillation of the screen assembly 20. An example of a construction which has functioned in accordance with the invention is a chip screen having a 2½ inch diameter circle of oscillation of the screen assembly 20 at 180 cycles per minute, and utilizing a ball 62 suspended as illustrated in FIG. 5, with a strand length from the center of the ball 62 to the top of the support rod 72 of approximately 3½ inches and a 2 inch diameter ball of natural rubber having an approximate density of 94 pounds per cubic foot. Bars 72 are positioned immediately beneath the screening member 60 extending transversely thereof. Spacing will depend on conditions of moisture and material, but one resonating ball per square foot has been shown to be effective for severe conditions.

Figure 4:
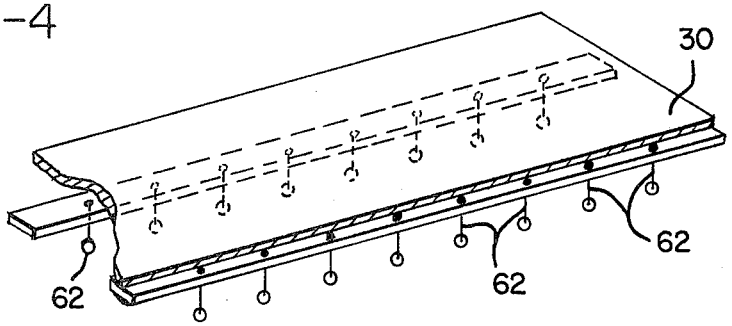
FIG. 4 is a perspective view of a portion of a dust pan as utilized in the embodiment of FIG. 1.

As shown in FIG. 4, a similar arrangement is utilized on the dust pans 30 to prevent sticking of the fines to the dust pan. In this case, a plurality of balls 62 are suspended beneath the dust pan using the same connecting arrangements described above in connection with the screen assembly 20.

An alternative to the type of construction described above is illustrated in FIG. 8. In this embodiment, a single strand of flexible material 120 is used, to which are attached a plurality of balls 122. In this embodiment two balls are shown, although more may be used depending upon their ability to go into a resonant motion in a plane during oscillation of the screen assembly 20 or dust pan 30.

The flexible strand 120 interconnects the balls 122 and suspends them from a bar 124 supported in the same manner as bar 72. The proper size and weight of the balls 122 and length of strand 110 can be determined in the same manner as that described above in connection with balls 62 and strands 64. Motion of this alternative embodiment, when the appropriate combination of mass of balls 122 and length of the strands 120 is provided, will be in a plane perpendicular to the plane of the paper in the illustration of FIG. 8.

Although the foregoing illustrates the preferred embodiments of the present invention, other variations are possible. All such variations as would be obvious to one skilled in this art are intended to be included within the scope of the invention as defined by the following claims.

What is claimed is:

1. In screening apparatus for separating particles of a desired size from other, smaller particles, including screening means and means for oscillating said screening apparatus with a gyratory movement, the improvement comprising:

a plurality of impacting members, means fixed with respect to and extending beneath surfaces of said screening apparatus, strand means suspending said impacting members from said means extending beneath said surfaces of said screening apparatus with said strand means disposed substantially vertically when said screening apparatus is not oscillating, said strand means suspending said impacting members from said means extending beneath said surfaces of said screening apparatus such that said impacting members are free to swing from a position of rest into contact with said surfaces when said screening apparatus is oscillated with said gyratory movement, and the length of said strand means and the mass of said impacting members being dimensioned with respect to the amplitude and frequency of said gyratory movement such that each of said impacting members swings in a plane in response to said gyratory movement of said screening apparatus.

2. The apparatus of claim 1 wherein:

each of said impacting members is independently suspended by an individual strand.

3. The apparatus of claim 1 wherein:

a plurality of said impacting members are suspended by an individual strand.

4. The apparatus of claim 3 wherein:

said strand by means of which said plurality of impacting members are suspended has opposite ends thereof secured to said means extending beneath said surfaces of said screening apparatus.

5. The apparatus of claim 1 wherein:

said means extending beneath said screening apparatus comprises bars connected to said screening apparatus.

6. The apparatus of claim 1 wherein:

said impacting members are suspended beneath said screening means.

7. The apparatus of claim 1 wherein:

said screening apparatus includes a collection tray, and said impacting members are suspended beneath said collection tray.

8. The apparatus of claim 1 wherein:

said impacting members comprise balls.

9. The apparatus of claim 1 wherein:

said strand means comprise relatively flexible members.

10. The apparatus of claim 1 wherein:

said strand means comprise spring members rigidly fixed at their upper ends to said means extending beneath said surfaces of said screening apparatus.

11. The apparatus of claim 1 wherein:

said strand means comprise substantially rigid rods pivotally mounted at their upper ends to said means extending beneath said surfaces of said screening apparatus.

12. In screening apparatus for separating wood particles of a desired size from other, smaller wood particles, including screening means, a collection tray positioned beneath said screening means and means for oscillating said screening apparatus including said screening means and said collection tray with a gyratory movement, the improvement comprising:

a plurality of bars extending beneath surfaces of said screening means and said collection tray and connected thereto for movement therewith, a plurality of strands fixed at their upper ends to said bars and extending substantially vertically downwardly away from said lower surfaces of said screening means and said collection tray, and balls attached to lower ends of said strands and adapted to strike said lower surfaces in response to gyratory movement of said assembly, the length of said strand means and the mass of said balls being dimensioned with respect to the amplitude and frequency of said gyratory movement such that each of said balls swings in a plane in response to said gyratory movement of said screening apparatus.

* * * * *